US006686684B2

(12) United States Patent
Van Der Wilk

(10) Patent No.: US 6,686,684 B2
(45) Date of Patent: Feb. 3, 2004

(54) COLOR SELECTION ELECTRODE IMPLEMENTING A TEMPERATURE BASED TENSION REDUCTION OF A SHADOW MASK

(75) Inventor: Ronald Van Der Wilk, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/914,087

(22) PCT Filed: Dec. 22, 2000

(86) PCT No.: PCT/EP00/13362

§ 371 (c)(1),
(2), (4) Date: Aug. 22, 2001

(87) PCT Pub. No.: WO01/48784

PCT Pub. Date: Jul. 5, 2001

(65) Prior Publication Data

US 2002/0125809 A1 Sep. 12, 2002

(30) Foreign Application Priority Data

Dec. 24, 1999 (EP) ..... 99204546

(51) Int. Cl.[7] ..... H01J 29/07

(52) U.S. Cl. ..... 313/407; 313/402; 313/404; 313/405; 313/408

(58) Field of Search ..... 313/402–408

(56) References Cited

U.S. PATENT DOCUMENTS

| | | | | | |
|---|---|---|---|---|---|
| 5,111,107 | A | | 5/1992 | Kume et al. | 313/405 |
| 5,742,116 | A | * | 4/1998 | Maki et al. | 313/402 |
| 6,114,148 | A | * | 9/2000 | Seed et al. | 435/252.3 |
| 6,307,310 | B1 | * | 10/2001 | Maehara et al. | 313/402 |

FOREIGN PATENT DOCUMENTS

| | | | | | |
|---|---|---|---|---|---|
| JP | 08022776 | A | * | 1/1996 | H01J/29/07 |
| JP | 11238472 | A | * | 8/1999 | H01J/29/02 |
| WO | WO9848439 | | | 10/1998 | H07J/29/07 |

* cited by examiner

*Primary Examiner*—Vip Patel
*Assistant Examiner*—Sikha Roy

(57) ABSTRACT

A cathode ray tube comprises a color selection electrode with a shadow mask fixed to a frame and put under tension. The frame comprises a bimetal element (or bimetal elements) which are constructed such that at a raised temperature the tension is released by reducing the distance between sides of the frame to which the mask is attached. The reduction in distance at the center of the sides exceeds, preferably by a factor 1.5 to 3, the reduction in distance at the corners of said sides.

11 Claims, 4 Drawing Sheets

COLOR SELECTION ELECTRODE IMPLEMENTING A TEMPERATURE BASED TENSION REDUCTION OF A SHADOW MASK

BACKGROUND OF THE INVENTION

1. Field of the Invention

The invention relates to a color cathode ray tube having a color selection electrode having a tension mask and a frame, which frame includes a plurality of interconnected parts each forming a side of the frame, whereby the tension mask is stretched under tension and connected at attachment points to at least said two parts, the frame having the capability to cause the attachment points to come closer together when the temperature increases.

Such cathode ray tubes are used in for instance television apparatuses and computer monitors.

2. Description of the Related Art

Color cathode ray tubes are usually provided with a color selection electrode, to shadow the electron beam(s) coming from the electron gun(s) mounted in the neck such that each beam excites only one color of luminescent material that is deposited on the inside of a display panel. This color selection is achieved by applying a color selection electrode, for instance a shadow mask inside the tube at a distance from the display panel. This mask employs a large number of apertures, usually arranged in a striped or dotted pattern. Conventional cathode ray tubes have a curved face plate, in most cases resembling either a spherical or a cylindrical surface. Recently more and more color cathode ray tubes have an (almost) flat surface. As a consequence also the color selection electrode has to become more and more flat. However, an (almost) flat shadow mask is very sensitive to doming and microphony problems. It has been known that stretching the shadow mask, i.e., putting it under tension reduces said problems, enabling a flatter shadow mask to be used. Cathode ray tubes having tensed shadow mask suffer, however, from a serious problem. The masks are put under a considerable tension. This tension is at operating temperatures lower than the yield stress of the shadow mask material because otherwise the shadow mask would be plastically deformed. During manufacturing of the cathode ray tube, however, the temperature is raised. Raising the temperature, reduces strongly the yield tension. Plastic deformation of the shadow mask then becomes a real possibility. After plastic deformation the tension in the shadow mask is reduced and in general the position of the apertures in the shadow mask may change. U.S. Pat. No. 5,111,107 discloses a cathode ray tube having a tension shadow mask (in U.S. Pat. No. 5,111,107 a slit-type mask) on a frame. The frame employs two attachment sides on which the mask is attached and two interconnecting sides. The interconnecting sides are provided with bi-metal elements which cause the interconnecting sides to bend inward at increased temperatures causing a reduction of the distance between the connection areas and thereby a reduction of the tension. To avoid plastic deformation the frame thus employs a bimetal element, which reduces the distance between the attachment areas or positions at the opposite sides (which could be seam or several welding points) when the temperature is raised. This reduction in distance releases or at least reduces the tension in the mask to a value (well) below the yield tension at said elvated temperature. Plastic deformation is thereby prevented. Such reduction can also be established by bimetal elements in or on the attachment sides. A design wherein the sides to which the color selection electrode is attached are provided with bimetal element to reduce the distance is for instance known from WO 98/48439. Bimetal element is within the concept to the invention to be understood to include a set of bimetal element or elements in which more than two metal are used. 'Metals' include metal alloys and metal compounds.

It has, however, been found by inventors that even with a reduction of the distances plastic deformation and/or a relatively poor doming and/or microphony behavior may nevertheless occur in particular at the central area of the mask

SUMMARY OF THE INVENTION

It is an object of the invention to improve the doming and/or microphony behavior of a cathode ray tube having a tensed color selection electrode and/or reduce problems caused by plastic deformation of the color selection electrode during manufacturing of the cathode ray tube.

To this end the cathode ray tube according to the invention is characterized in that the attachment parts comprise bimetal elements to reduce, when the temperature is raised, the distance between the attachment areas more at the center of attached sides of the color selection electrode than at the corners of said sides.

The invention is based on the insight that if the distance between the sides is reduced with a substantially equal amount along the attachment sides, the amount of tension released is less at the center of the side than at the corners. As a consequence, if an evenly distributed tension is released by reducing the distance with an equal amount for each side, the amount being such that at the corners the tension is reduced to substantially zero, there still remains a very considerable tension at the center which remaining tension could lead to plastic deformation. By reducing the distance more at the center than at the corners, the remaining tension is reduced.

Thus the risk of plastic deformation is reduced. It is remarked that in some designs (such as for instance the design shown in WO 98/48439) the color selection electrode is unevenly tensioned, i.e. the tension at room temperature is much less in the center than at the corners. In such designs the plastic deformation is less of a problem. Though at high temperatures there is less tension released at the center than at the corners, there was less tension at the center to begin with. However, in such designs the tension at operating temperatures at the center is much less (often less than half) of the maximum tension possible. Compared to such designs, the invention offers the possibility to increase the tension at the center which improves the doming and microphony characteristics of the color selection electrode.

Preferably the ratio of reduction in distance between that at the center and the corners is between 1.3 and 3.

The ratio is chosen to compensate for the effects of a difference in stiffness in the sides. The stiffer the sides are, the smaller the ratio needed, and also the less effect the invention has. For very small ratio (less than 1.3) the positive effects of adding of modifying the bimetal element are relatively small. For high ratio's the effects of the invention are large, but equally large effects may be more easily obtained by stiffening the sides to first reduce the ratio.

Preferably the frame comprises a further bimetal element in the sides perpendicular to the attachment sides to reduce the distance between the attachment sides as whole.

Within the concept of the invention are embodiments in which bimetal elements on the attachment sides provide both for a reduction in distance of the sides as a whole (which can be seen as a 'bias' reduction of distance), as for a difference in distance between the center and the corners. Preferably however, the attachment sides as a whole are moved closer to each other by a bimetal element in (or on) the sides perpendicular to the attachment sides, and the difference in reduction of distance is achieved by bimetal elements on or in the attachment sides.

Such embodiments are most preferred when the ratio in reduction of distances (as defined above) lies between 1.5 and 2.5. Each bimetal element then achieves an approximately equal effect.

Preferably the cathode ray tube comprises a color selection electrode made of a material having a low coefficient of thermal expansion, such as NiFe alloys.

These and other aspects of the invention will be apparent from and elucidated with reference to the embodiments hereinafter.

BRIEF DESCRIPTION OF THE DRAWINGS

In the drawings.

The FIGS. 1–6 are not drawn to scale. In general, like reference numerals refer to like pars.

DETAILED DESCRIPTION OF THE PRESENTLY PREFERRED EMBODIMENTS

Figure 1:
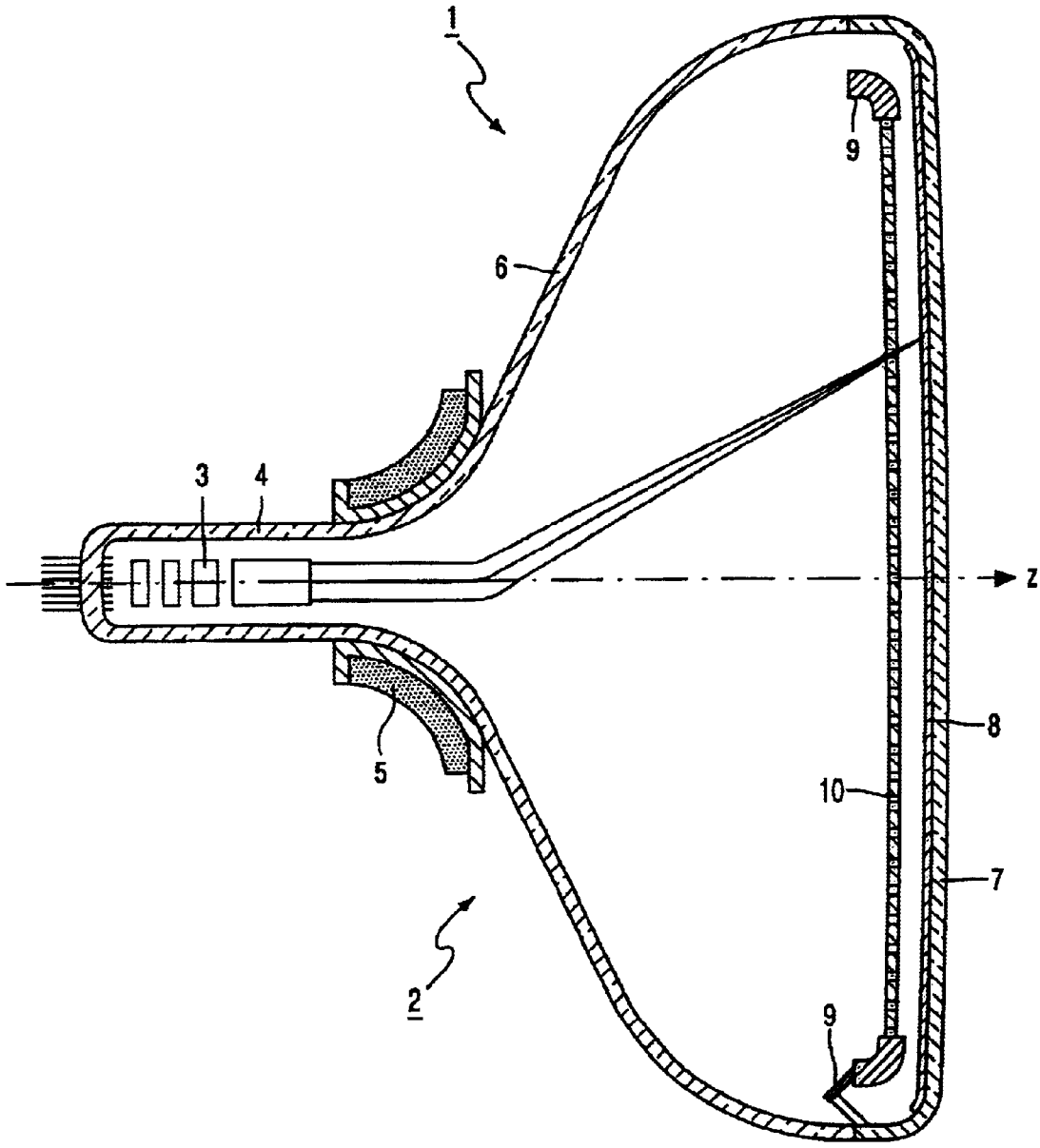
FIG. 1 is a side elevation, partly broken away, of a color display device having a color cathode ray tube with a color selection electrode.

The cathode ray tube 1 shown in FIG. 1 comprises an evacuated glass envelope 2 with a neck 4, a funnel shaped part 6 and a front panel 7, which can either be curved or flat. On the inside of the display panel 7, a display screen 8 having a pattern of for example lines or dots of phosphors luminescing in different colors (e.g., red, green and blue) may be arranged. A substantial rectangular frame 9 supports a thin mask 10 at a short distance form the display screen 8. The mask may be an apertured mask having circular or elongated aperture or a wire mask. The mask may be made of iron or an iron alloy (e.g., a NiFe alloy). During operation of the tube, an electron gun system 3 arranged in the neck 4 generates electron beams. These electron beams pass through the apertures of mask 10 so that the phosphors will emit light. A deflection device 5 ensures that the electron beams systematically scan the display screen.

Figure 2A:
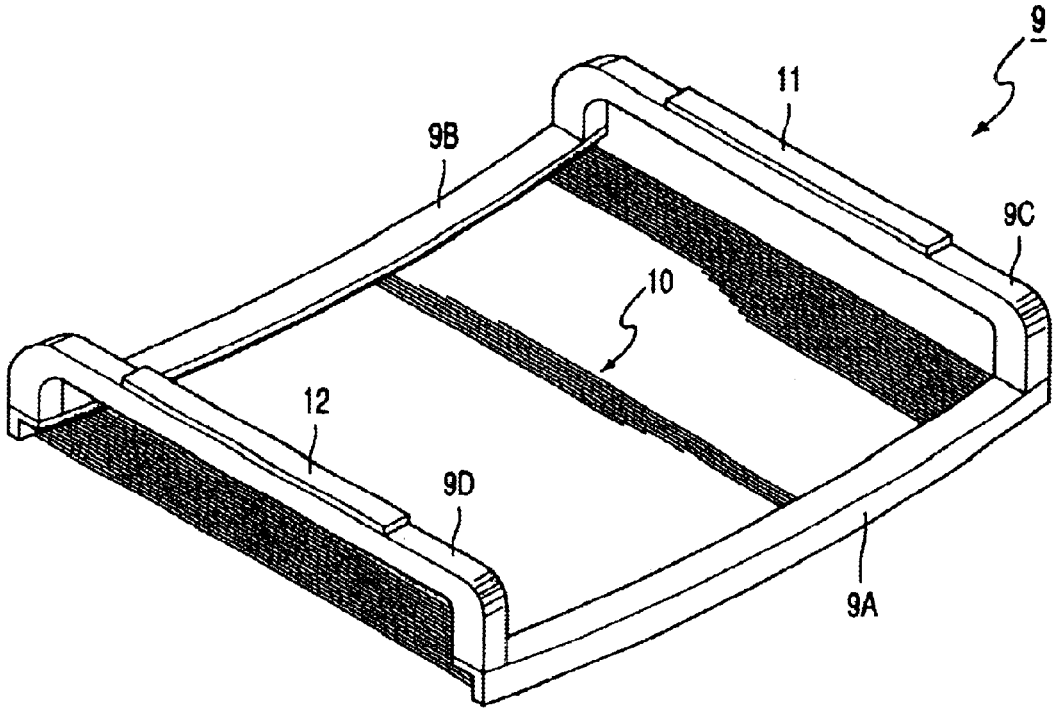
FIG. 2A PRIOR ART
FIGS. 2A and 2B show a color selection electrode with a frame as known from U.S. Pat. No. 5,111,107.
Figure 2B:
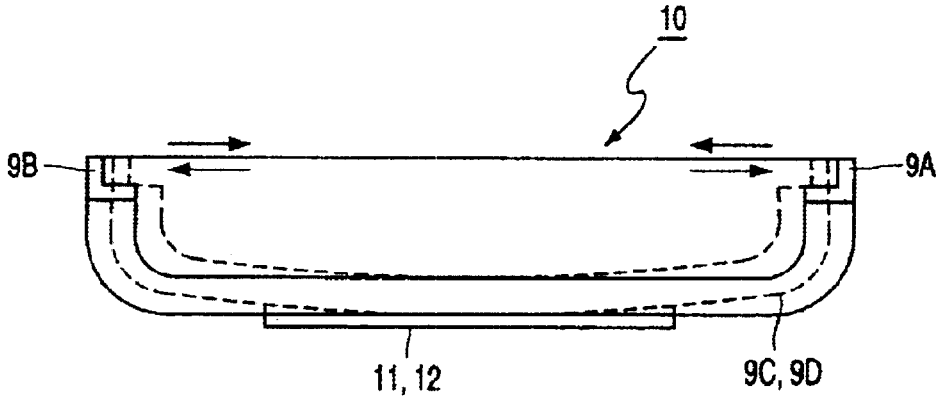
FIG. 2B PRIOR ART

FIGS. 2A and 2B show a color selection electrode as known from U.S. Pat. No. 5,111,107. The color selection electrode comprises frame 9, having attachment sides 9A and 9B and sides 9C and 9D perpendicular to the attachment sides 9A and 9B. Before the mask 10, is provided the sides 9A and 9B are pushed inward. In the following description the amount of inward pushing (compared to a Situation in which there is no tension at all) is called the 'inward deflection'. The force needed to push a point on a side inward by a standard amount is related to the stiffness of that side at that particular point. When the color selection electrode is attached and the pushing force is released, the color selection electrode is under tension. The sides 9C and 9D are provided with metal strips 11 and 12. FIG. 2B illustrates that, when the temperature is raised, the difference in thermal expansion between the material of sides 9C and 9D and the metal of strips 11 and 12 causes the sides 9C and 9D to bend, which brings sides 9A and 9B closer together. This releases (at least partly) the tension put on the mask 10. In this manner plastic deformation is avoided.

Figure 3:
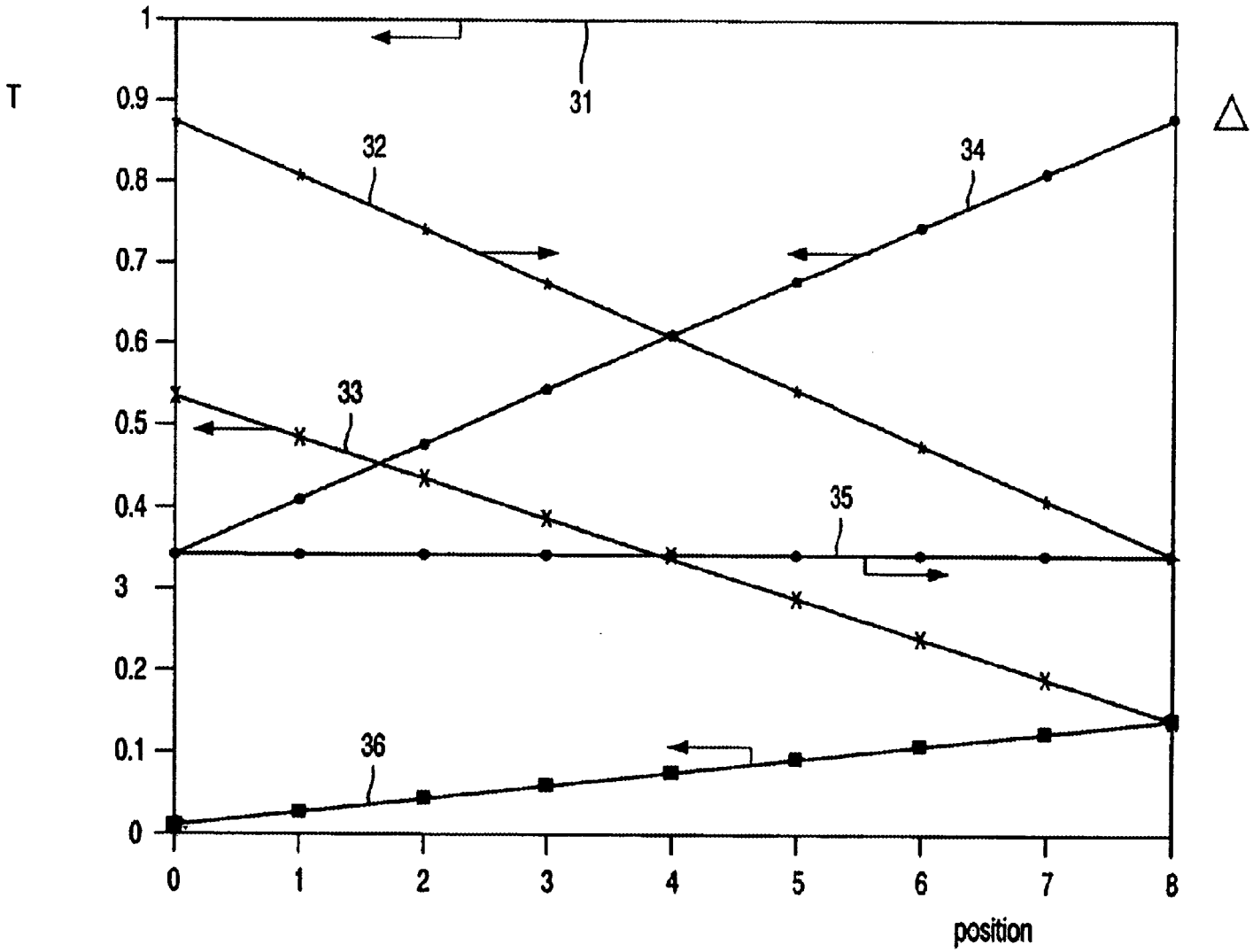
FIG. 3 shows in graphical form the tension and the inward distance at low and at high temperatures for known devices.

FIG. 3 shows in a graphical form and schematically the tension T (left hand vertical axis) and the inward deflection Δ (right hand vertical axis) as a function of position (horizontal axis) where 0 stands for the center of the sides 9A and 9B and 8 for the corners. Line 31 denotes a situation in which, at room temperature, the tension T is evenly distributed (i.e., the pushing force is everywhere the same and in the Figure normalized at 1). In such a situation the inward deflection is, however, far from the same along the sides 9A and 9B. The center is appreciably more inwardly deflected than the corners. The sides 9A and 9B are less stiff at the center than at the corners. With the same force the center can for instance be pushed inward by an amount of 3 mm, while the corners are pushed inward by only 1.5 mm. Line 32 which denotes the inward deflection Δ corresponding to the tension of line 31 schematically illustrates such a situation. The inward deflection Δ is much larger at the center (position 0) than at the corners (position 8). When the distance is reduced and the distance reduction is the same throughout the side, the inward deflection at the center is still very appreciable when the inward deflection at the corner is reduced to a very low value. Line 33 illustrates such a situation. Although the tension is reduced to nearly zero at the corners, since Δ is nearly zero, it still is appreciable at the center, typically several tens of percent, of the original tension. If, for instance, the tension under which the mask is put at room temperature is 90% of the tension at which, at room temperature, plastic deformation occurs, and the tension at which plastic deformation occurs at high temperatures is 30% of that at room temperature, plastic deformation at the center will occur as a consequence of the still high tension at the center and the reduced yield strength of the material at said high temperatures. The occurrence of said effects can be reduced by reducing the tension under which the mask is stretched (in this example for instance to under 60%) but this will increase doming and increase microphony.

The occurrence of such effects can also be avoided by giving sides 9A and 9B a constant inward deflection. Such a situation is illustrated in line 35 (constant deflection <). The tension at room temperature is much higher at the corners than at the center (see line 34). When the temperature is raised the tension is reduced at the center as well as at the corners. It is reduced less at the center than at the corners, but since the tension at the center was (at room temperature) less than at the corners, at high temperatures the tension is released throughout the mask Plastic deformation is avoided, but at a cost, since at room temperature the tension at the center of the color selection electrode is much less (typically half to a third) of the maximum tension possible. That increases the risk of doming and bothersome microphony behavior.

In both of the above known constructions the tension at room temperature is less than optimal to avoid plastic deformation at high temperatures.

In a cathode ray tube in accordance with the invention the frame is provided with a bimetal element (or a number of bimetal elements) which effect at an increase of temperature an inward curving of sides 9A and 9B (i.e., the sides to which the mask is attached), the curving being such that the inward deflection at the center of said sides exceeds the inward deflection at the corners of said sides. For instance going from room temperature to 450° C., which is a temperature increase which typically occurs during manufacturing of the cathode ray tube, the inward deflection is larger by for instance a factor 1.5 to 3, at the center than at the corner This enables a higher tension to be employed. As can he seen in FIG. 3 when at room temperature the sides 9A and 9B are tensed with the same high tension (line 31) the inward deflection <(line 32) is roughly twice as high in the center (point 0) than at the corners (point 8). By reducing the inward deflection <at the center twice as much as at the corners the high tension (line 31) can be reduced to a low more or less evenly distributed tension at high temperatures (line 36).

Figure 4:
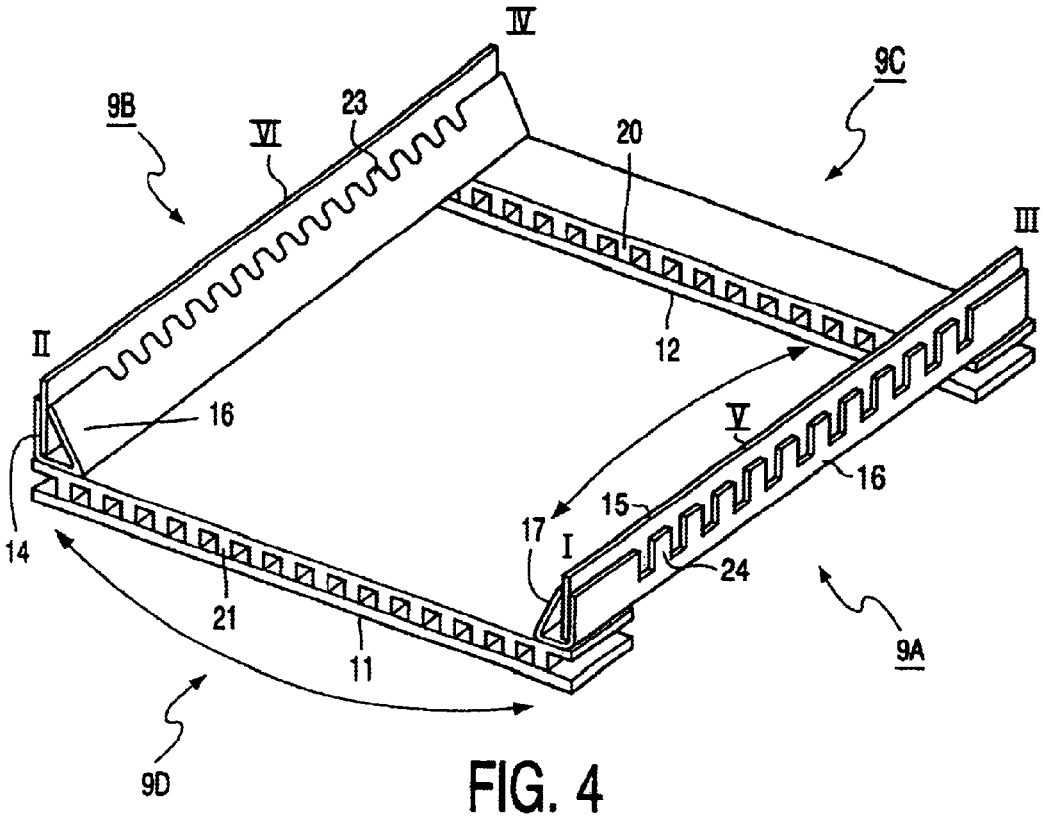
FIG. 4 shows a color selection electrode for use in a cathode ray tube in accordance with the invention.

FIG. 4 shows a color selection electrode for use in a cathode ray tube in accordance with the invention. Sides 9C and 9D are provided with metal elements 11 and 12 with a higher thermal expansion coefficient than other parts of said sides. As a consequence when the temperature is raised the sides 9C and 9D will bulge (in FIG. 4 schematically indicated by the curved arrow under side 9D) bringing the corner points I, II, III and IV, and the center points V and VI of the sides 9A and 9B together. The sides 9A and 9B are at the outer facing surfaces provided with metal elements 14 and 15 with a lower thermal expansion coefficient than for instance parts 16 and 17. These metal elements 14, 15 have a smaller thermal expansion than the inner parts 16, 17 of said sides 9A and 9B. As a consequence sides 9A and 9B will bulge inward when the temperature is raised, (in FIG. 4 schematically indicated by curved arrow in front of side 9A) thus reducing the distance between the center points V and VI than between the corners points I and II, respectively III and IV. Sides 9A and 9B could also be provided with metal elements at the inner side of said sides, if such elements have a higher thermal expansion coefficient. The metal elements 11 and 12 on sides 9C, 9D provide for a 'bias' inward deflection, whereas low thermal expansion elements 14 and 15 in cooperation with parts 16, 17 provide for an inward bulging which is greater at the center (between points V and VI) than at the corners of the sides 9A and 9B.

In a preferred embodiment, the lower part of sides 9C and 9D (i.e. elements 11 and 12) are attached to the upper part via a number of bridges 20, 21. In a preferred embodiment sides 16 and 17 lie against the upstanding edge by means of fingers 23.

Figure 5:
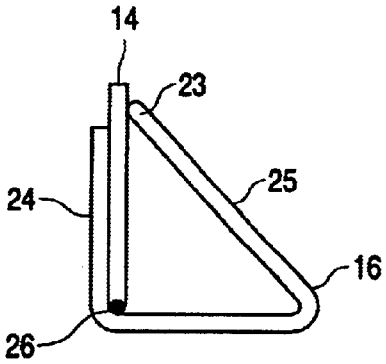
FIG. 5 shows in cross-sectional view a part of the color selection electrode of FIG. 4.

In a preferred embodiment, plates 14, 15 of the sides 9A and 9B are made of a material having a relatively low thermal expansion (such as an NiFe alloy) while plates 16, 17 are made of a material having a relatively higher thermal expansion coefficient. FIG. 5 shows in cross-sectional view in more detail a side 9B. The part 16 is made into a (in cross-sectional), triangular form, and made of iron and a plate 14 of an NiFe alloy is attached to an inner side 25 with the fingers 23 by spot welds, plates 14 and 16 are also welded at the bottom (points 26). The triangular form of part 16 is completed by means of fingers 24.

Figure 6:
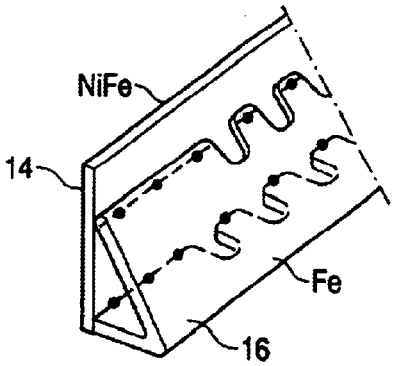
FIG. 6 shows in cross-sectional view a part of an embodiment of the invention.

FIG. 6 shows an alternative shape for parts 14, 16. In this example the fingers 24 at the outward facing side of part 14 are omitted and part 14 is soldered to part 16 at soldering points, which are schematically indicated by dots. When the temperature rises the difference in thermal expansion of parts 24 and 14, 16 causes an inward deflection of the parts 24 and 14. The triangular form and the fingers 23 ensure that this curving is not made impossible or hindered too much by the rest of the triangular shaped part.

It will be clear that within the concept of the invention many variations are possible.

In short the invention can be described by.

A cathode ray tube comprises a color selection electrode with a shadow mask fixed to a frame and put under tension. The frame comprises a bimetal element (or bimetal elements) which are constructed such that at a raised temperature the tension is released by reducing the distance between sides of the frame to which the mask is attached. The reduction in distance at the center of the sides exceeds, preferably by a factor 1.5 to 3, the reduction in distance at the corners of said sides.

What is claimed is:

1. A color selection electrode incorporated within a color cathode ray, said color selection electrode comprising:

a shadow mask (10); and a frame including a first side (9B), a second side (9A), and a third side (9C), wherein said shadow mask (10) is attached to said first side (9B) and said second side (9A), and unattached to said third side (9C), wherein said first side (9B) includes a first bimetal element (16) fabricated from a first material having a first thermal expansion coefficient, wherein said first side (9B) further includes a second bimetal element (14) fabricated from a second material having a second thermal expansion coefficient that is less than the first thermal expansion coefficient, wherein said third side (9C) is fabricated from a third material having a third thermal expansion coefficient that is greater than the first thermal expansion coefficient, wherein, in response to a temperature increase of said frame, said first side (9B) and said second side (9A) reduce a first distance between a center of said first side (9B) and a center of said second side (9A), and reduce a second distance between a corner of said first side (9B) and a corner of said second side (9A), a reduction of the first distance being greater than a reduction of the second distance, and wherein, in response to the temperature increase of said frame, said third side (9C) reduces a third distance between a whole of said first side (9B) and a whole of said second side (9A).

2. The color selection electrode of claim 1, wherein a ratio of the reduction of the first distance and the reduction of the second distance is between a range of 1.3 and 3.

3. The color selection electrode of claim 1, wherein a ratio of the reduction of the first distance and the reduction of the second distance is between a range of 1.5 and 2.5.

4. The color selection electrode of claim 1, wherein said first bimetal element (16) includes an outer side (24) and an inner side (25) spaced from said outer side (24); and wherein said second bimetal element (14) is disposed between said outer side (24) and said inner side (25).

5. The color selection electrode of claim 1, wherein said first bimetal element (16) includes a plurality of fingers soldered to said second bimetal element (14).

6. The color selection electrode of claim 1, wherein said frame further includes a fourth side (9D);

wherein said fourth side (9D) is fabricated from the third material having the third thermal coefficient; and wherein, in response to the temperature increase of said frame, said third side (9C) and said fourth side (9D) reduce the third distance between the whole of said first side (9B) and the whole of said second side (9A).

7. A color selection electrode incorporated within a color cathode ray, said color selection electrode comprising:

a shadow mask (10); and a frame including a first side (9B), a second side (9A), and a third side (9C), wherein said first side (9B) includes a first bimetal element (16) and a second bimetal element (14), wherein said first bimetal element (16) includes an outer side (24) and an inner side (25) spaced from said outer side (24), wherein said second bimetal element (14) is disposed between said outer side (24) and said inner side (25), wherein, in response to a temperature increase of said frame, said first side (9B) and said second side (9A) reduce a first distance between a center of said first side (9B) and a center of said second side (9A), and reduce a second distance between a corner of said first side (9B) and a corner of said second side (9A), a reduction of the first distance being greater than a reduction of the second distance, and wherein, in response to the temperature increase of said frame, said third side (9C) reduces a third distance between a whole of said first side (9B) and a whole of said second side (9A).

8. The color selection electrode of claim 7, wherein a ratio of the reduction of the first distance and the reduction of the second distance is between a range of 1.3 and 3.

9. The color selection electrode of claim 7, wherein a ratio of the reduction of the first distance and the reduction of the second distance is between a range of 1.5 and 2.5.

10. The color selection electrode of claim 7, wherein said first bimetal element (16) includes a plurality of fingers soldered to said second bimetal element (14).

11. The color selection electrode of claim 7, wherein said frame further includes a fourth side (9D);

wherein said fourth side (9D) is fabricated from the third material having the third thermal coefficient; and wherein, in response to the temperature increase of said frame, said third side (9C) and said fourth side (9D) reduce the third distance between the whole of said first side (9B) and the whole of said second side (9A).

* * * * *